US008435075B2

(12) United States Patent
Lim et al.

(10) Patent No.: US 8,435,075 B2
(45) Date of Patent: May 7, 2013

(54) METAL SHELL CONFIGURATION FOR AN ELECTRICAL CONNECTOR

(75) Inventors: Kian Heng Lim, Lisle, IL (US); Jun Xian Yong, Lisle, IL (US)

(73) Assignee: Molex Incorporated, Lisle, IL (US)

( * ) Notice: Subject to any disclaimer, the term of this patent is extended or adjusted under 35 U.S.C. 154(b) by 343 days.

(21) Appl. No.: 12/956,104

(22) Filed: Nov. 30, 2010

(65) Prior Publication Data

US 2011/0130019 A1 Jun. 2, 2011

(51) Int. Cl.
*H01R 13/648* (2006.01)

(52) U.S. Cl.
USPC ..... 439/607.35

(58) Field of Classification Search ..... 439/607.35, 439/607.53, 607.54, 607.55, 607.56
See application file for complete search history.

(56) References Cited

U.S. PATENT DOCUMENTS

| | | | | |
|---|---|---|---|---|
| 6,478,623 | B1 * | 11/2002 | Wu | 439/607.35 |
| 7,097,504 | B2 * | 8/2006 | Kan | 439/607.35 |
| 7,182,641 | B2 * | 2/2007 | Shimoyama | 439/607.35 |
| 2004/0224563 | A1 * | 11/2004 | Zhu et al. | 439/668 |
| 2010/0210124 | A1 * | 8/2010 | Li | 439/108 |

* cited by examiner

*Primary Examiner* — Vanessa Girardi
(74) *Attorney, Agent, or Firm* — Stephen L. Sheldon

(57) ABSTRACT

An electrical connector comprises a dielectric body, a plurality of terminals, and a metal shell. The dielectric body includes a base and a tongue. The tongue extends forward from the base and supports the plurality of terminals. The metal shell is integrally formed around the dielectric body, and can be formed by bending a metal plate, and includes a top wall, a bottom wall opposite to the top wall, a first side wall, and a second side wall, the four walls defining a rectangular opening. The first side wall includes a lower wall portion and an upper wall portion, both of which are joined at a seam on the first side wall. The lower wall portion has a lower solder leg and the upper wall portion has an upper solder leg and the lower and upper solder legs can be soldered to the circuit board.

18 Claims, 17 Drawing Sheets

METAL SHELL CONFIGURATION FOR AN ELECTRICAL CONNECTOR

RELATED APPLICATIONS

This application claims priority to Chinese Application No. 200920270836.8, filed Nov. 30, 2009, which is incorporated herein by reference in its entirety.

FIELD OF THE INVENTION

The present invention relates to an electrical connector and an electrical connector assembly, and relates more particularly to an electrical connector and an electrical connector assembly having a rigid metal shell.

DESCRIPTION OF THE RELATED ART

Electrical connectors are usually enclosed with metal shells for preventing electromagnetic interference. The metal shells and dielectric bodies mutually define receiving cavities for connecting mated connectors. If the metal shells are not sufficiently robust, the metal shells may easily be deformed or damaged by improper force or twisting force caused when the mated connectors are inserted or pulled out. Further, the metal shells determine the sizes of the electrical connectors. As electronic devices are becoming more compact, electrical connectors also have to become smaller so as to avoid using too much space.

FIGS. 1 and 2 show a current connector socket 9 disclosed in Chinese Patent No. ZL 200620002331.X (Taiwan counterpart patent TW M299552 and U.S. Pat. No. 7,371,116), configured for receiving external serial ATA (eSATA) and universal serial bus (USB) plugs. The metal casing 91 of the electrical connector 9 is formed by bending a metal plate, including a dovetail structure having a mated tongue and a groove, which are engaged with each other on the bottom wall 911, constituting a planar butt-joint seam 912. Because the metal casing 91 is merely butt jointed, the joint may be easily damaged by improper insertion force and twisting force caused by a mated connector. Although, in some instances, impressions are formed on the seam of the metal casing to deform local areas for enhancing the joint strength, such strength-enhancing methods cannot sufficiently strengthen the metal casings to be able to withstand improper insertion force and a stricter insertion test. As shown in FIG. 1, the current connector socket 9 has a lower protection plate 921 on the bottom of the insulating body 92. An insertion hole 922 is formed on the lower protection plate 921. The insertion hole 922 and the butt-joint seam 912 of the metal casing 91 cooperate with an insertion slice 913 extending backward to generate locking force. The lower protection plate 921 supports the butt-joint seam 912 to prevent the butt-joint seam 912 of the metal casing 91 from being torn apart due to manufacturing imperfections or improper use. However, the lower protection plate 921 is of plastic material that cannot provide the metal casing 91 with sufficient support force. Further, the lower protection plate 921 increases the height of the current connector socket 9. Thus, such a design cannot satisfy the requirement of compactness.

U.S. Pat. No. 5,993,258 discloses an electrical connector including connector body fastening to a printed circuit board by terminal legs and fixing legs of a shell. The shell has auxiliary legs for being attached to the printed circuit board. The auxiliary leg is composed of a projecting slice, which extends from the joint side of the shell and beyond the shell. The auxiliary legs are formed on the bottom surface of the shell contacting the printed circuit board, and the joint seam is formed on the same bottom surface. The bottom surface is parallel to the surface of the printed circuit board, on which improper insertion force and twisting force acts. If the joint is not strong, it will be the weak point of the shell. In addition, such a design can only be applied to board-mounting connectors soldered onto printed circuit boards, and cannot be applied to sink-type connectors positioned in openings of printed circuit boards to which the sink-type connectors are soldered.

U.S. Pat. No. 6,398,587 (Chinese counterpart patent Number CN00264388.x; Taiwan counterpart patent Number 502883) discloses an electrical connector that includes a metal shell having two arms extending from the top of the metal shell toward two side walls. The distal end of each arm is adapted to have a bending portion as a solder portion for weld attachment to a printed circuit board. Each bending portion is positioned higher than the bottom of the metal shell. However, such an electrical connector has the same drawbacks as those of the electrical connector disclosed in U.S. Pat. No. 5,993,258. In addition, each arm extends too far, which is another drawback of the electrical connector.

SUMMARY

An embodied electrical connector assembly comprises a circuit board and an electrical connector soldered to the circuit board. The electrical connector comprises a dielectric body, a plurality of terminals, and a metal shell. The dielectric body includes a base and a tongue extending forward from the base. The plurality of terminals are disposed on the tongue. The metal shell is integrally formed around the dielectric body. The metal shell, formed by bending a metal plate, includes a top wall, a bottom wall opposite to the top wall, a first side wall, and a second side wall, the four walls defining a rectangular opening. The first side wall includes a lower wall portion and an upper wall portion, both of which are jointed at a seam on the first side wall. The lower wall portion has a lower solder leg extending in a direction toward the circuit board. The upper wall portion has an upper solder leg extending in the direction toward the circuit board. The lower and upper solder legs are soldered to the circuit board. The seam of the metal shell of the embodied electrical connector is arranged on the first side wall of the metal shell. The lower wall portion and the upper wall portion are butt jointed and fastened by a dovetail joint at the seam.

BRIEF DESCRIPTION OF THE DRAWINGS

The detailed description will be described according to the appended drawings in which.

DETAILED DESCRIPTION

One benefit of the depicted embodiments is the ability to provide an electrical connector including a metal shell having a reliable interlocking structure, wherein the metal shell does not increase the size of the electrical connector. In one embodiment, an electrical connector comprises a dielectric body, a plurality of terminals, and a metal shell. The dielectric body includes a base and a tongue extending forward from the base. The plurality of terminals are disposed on the tongue. The metal shell is integrally formed around the dielectric body. The metal shell, formed by bending a metal plate, includes a top wall, a bottom wall opposite to the top wall, a first side wall, and a second side wall, the four walls defining a rectangular opening. The first side wall includes a lower wall portion and an upper wall portion, both of which are jointed at a seam on the first side wall. The lower wall portion has a lower solder leg extending in a direction toward the bottom wall. The upper wall portion has an upper solder leg extending in the direction toward the bottom wall.

As noted above, the lower wall portion and the upper wall portion are butt jointed and fastened by a dovetail joint at the seam. Because the dovetail joint is on the first side wall, the damage caused by improper insertion force and twisting force from a mated connector can be avoided. In particular, such a configuration in which the dovetail joint is on the first side wall can effectively prevent the damage of the metal shell if improper insertion force and twisting force is applied on the top wall and the bottom wall. Thus, the metal shell of the electrical connector has improved rigidity. In addition, the seam is on the outside of a lateral arm of the dielectric body, which can effectively withstand improper insertion force and twisting force and avoid the effect of such forces directly on the first side wall of the metal shell, thereby increasing the robustness of the joint at the seam.

Moreover, the electrical connector can further sustain improper force and twisting force applied on its top wall and bottom wall by soldering the lower solder leg and the upper solder leg, which extend respectively from the lower wall portion and the upper wall portion and along a direction toward the circuit board, in a hole of the circuit board. Further, an indentation formed on the lower solder leg and an indention formed on the upper solder leg allow filling of more solder so as to increase the solder strength between the lower and upper solder legs and the hole, allowing the structure to withstand further improper insertion force and twisting force applied to the top wall and bottom wall.

Figure 1:
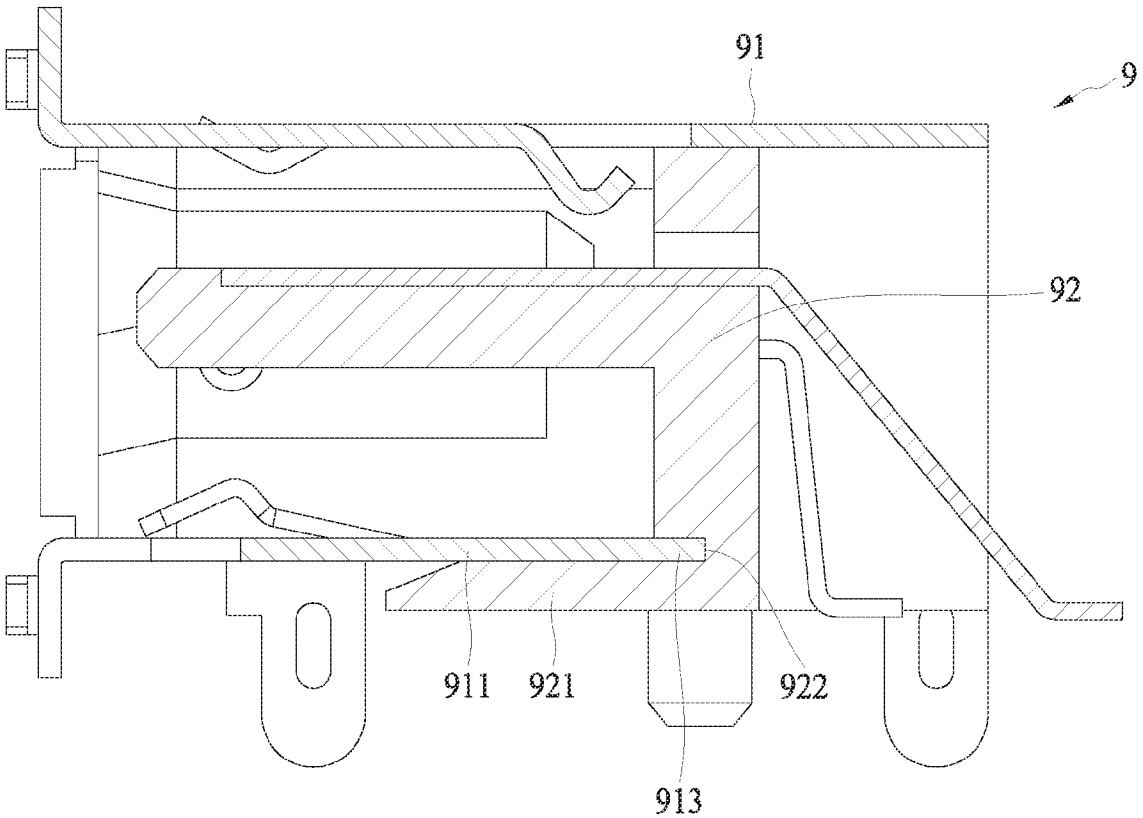
FIG. 1 (Prior Art)
FIG. 1 is a perspective view showing a conventional electrical connector.
Figure 2:
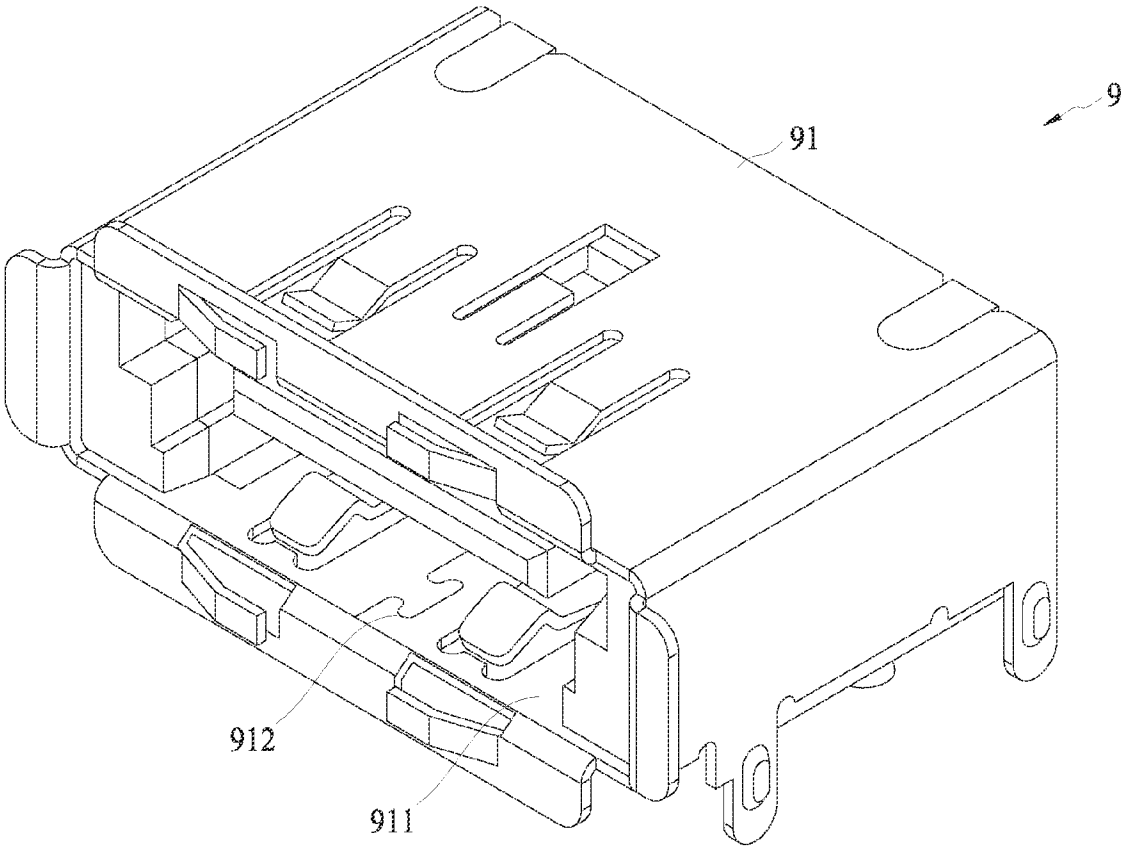
FIG. 2 (Prior Art)
FIG. 2 is a sectional view showing the metal shell of a conventional electrical connector.
Figure 3:
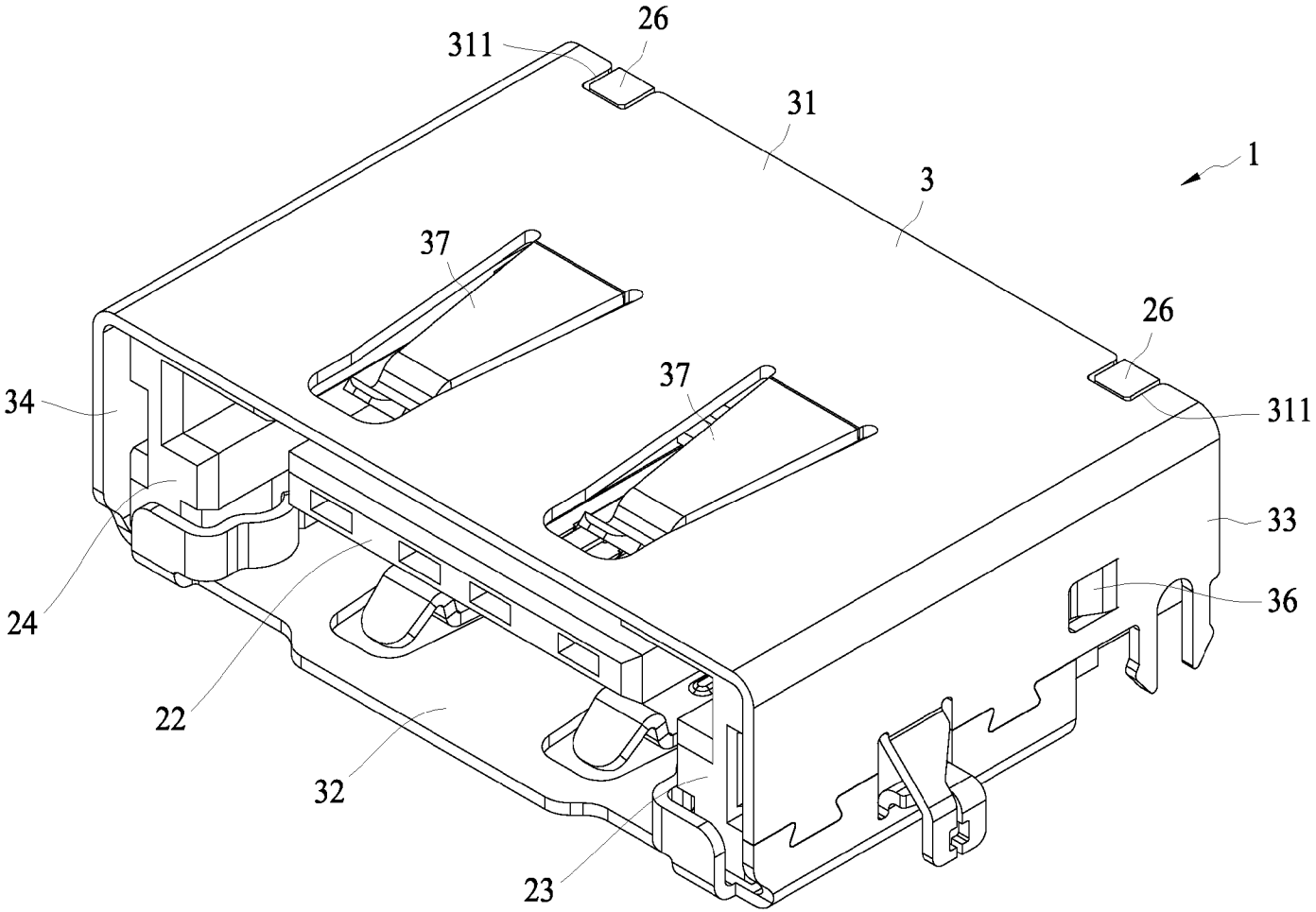
FIG. 3 is a perspective view showing an embodiment of an electrical connector.
Figure 4:
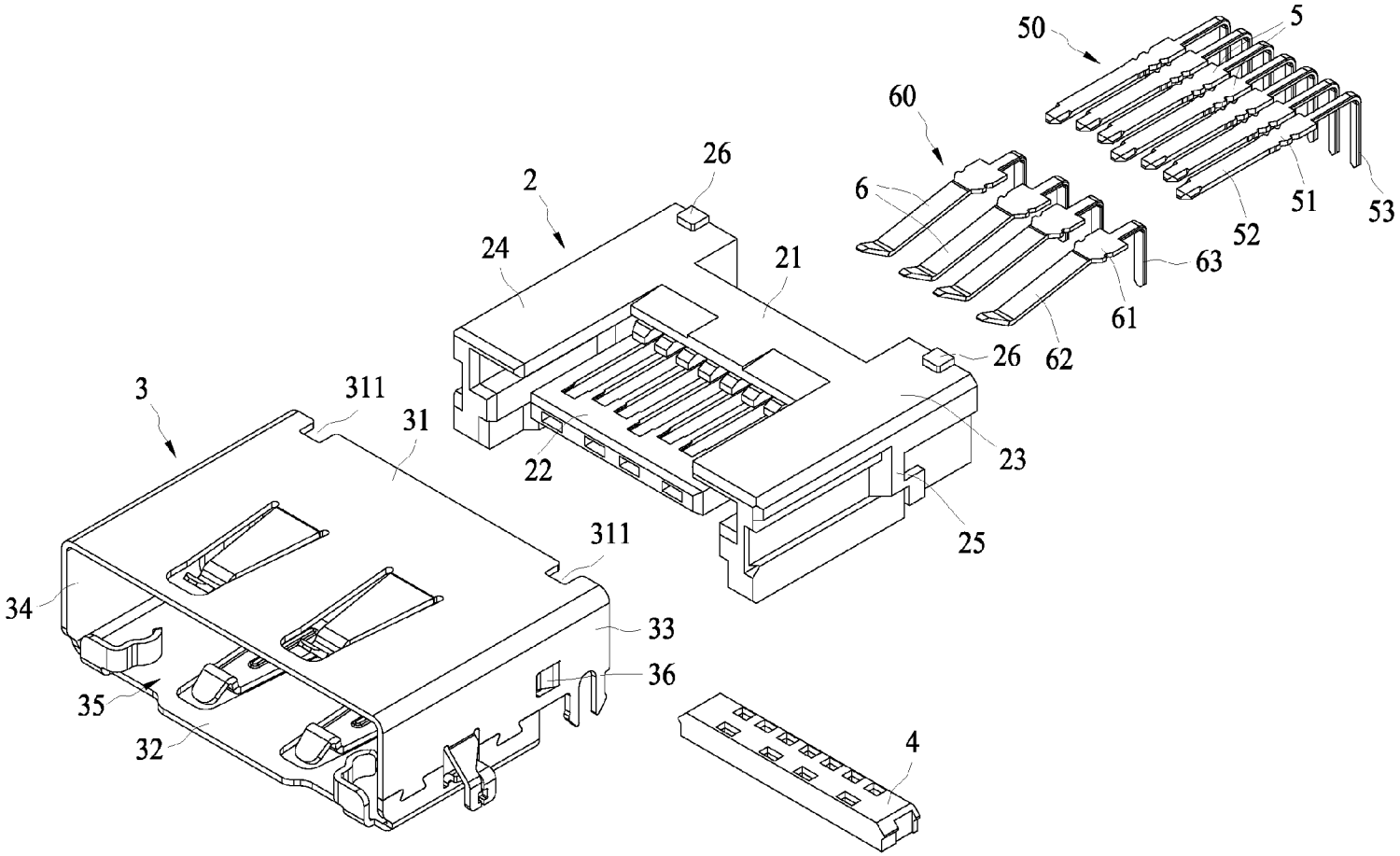
FIG. 4 is an exploded view showing the electrical connector of FIG. 3.
Figure 5:
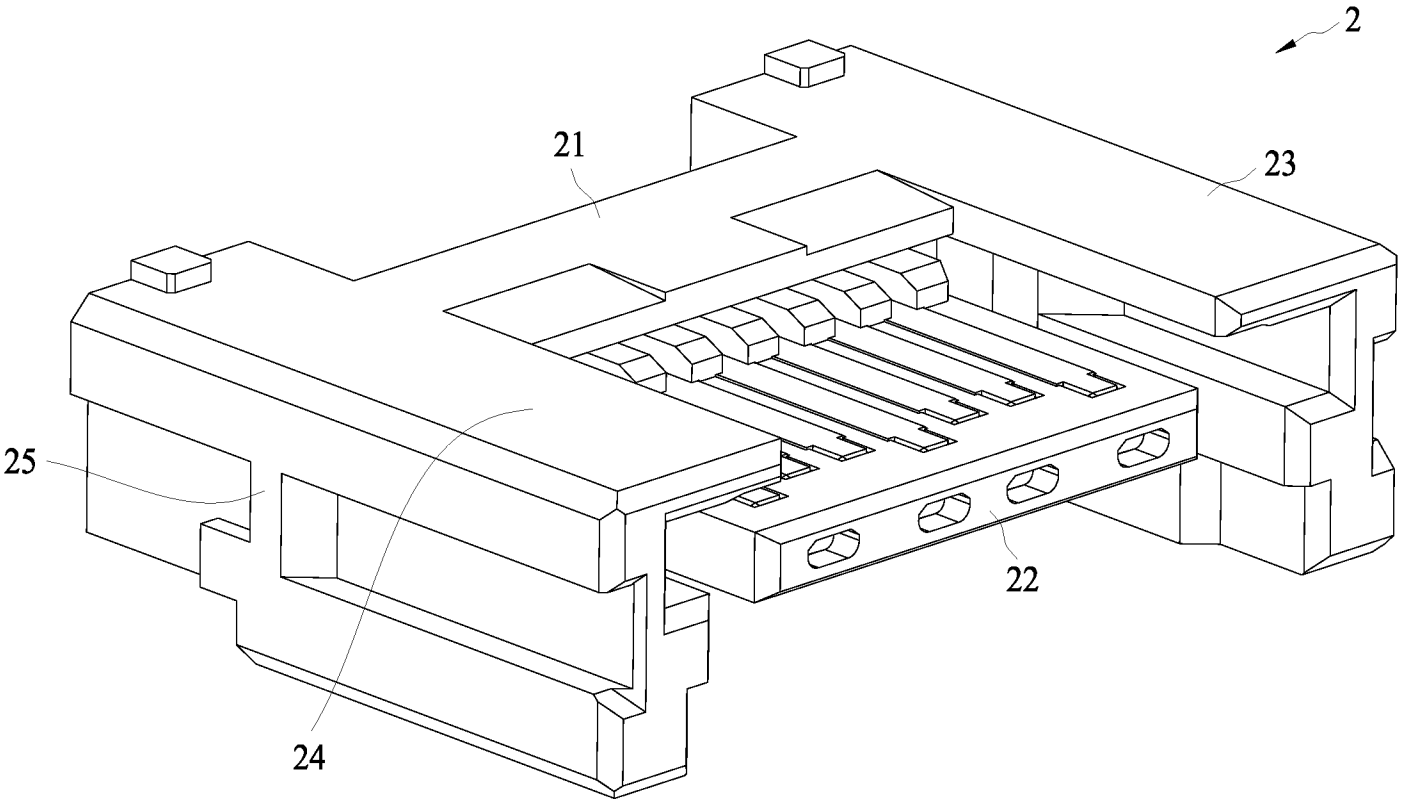
FIG. 5 is a perspective view depicted from another angle, showing the dielectric body of the electrical connector of FIG. 4.

Referring to FIGS. 3 through 5, in a preferred embodiment of the present invention, an electrical connector 1 comprises a dielectric body 2, a plurality of terminals, a metal shell 3, and a terminal positioned member 4. In one embodiment of the present invention, the plurality of terminals are arranged in two groups: the terminals in one terminal group 50 are adapted to comply with the external serial advanced technology attachment (eSATA) specification, and the terminals in another terminal group 60 are adapted to comply with the universal serial bus (USB) specification.

Figure 6:
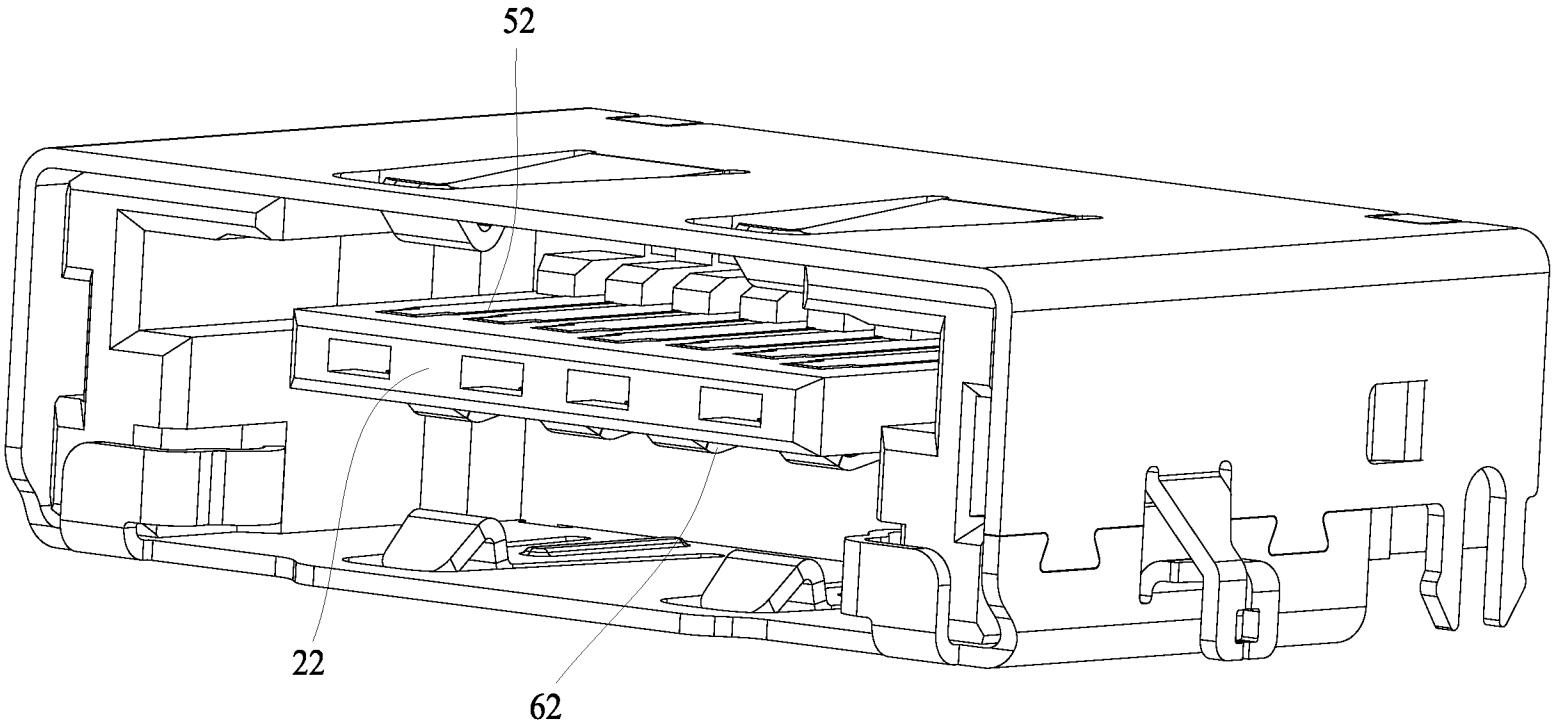
FIG. 6 is a perspective view of an embodiment of the electrical connector depicted in FIG. 3.
Figure 7:
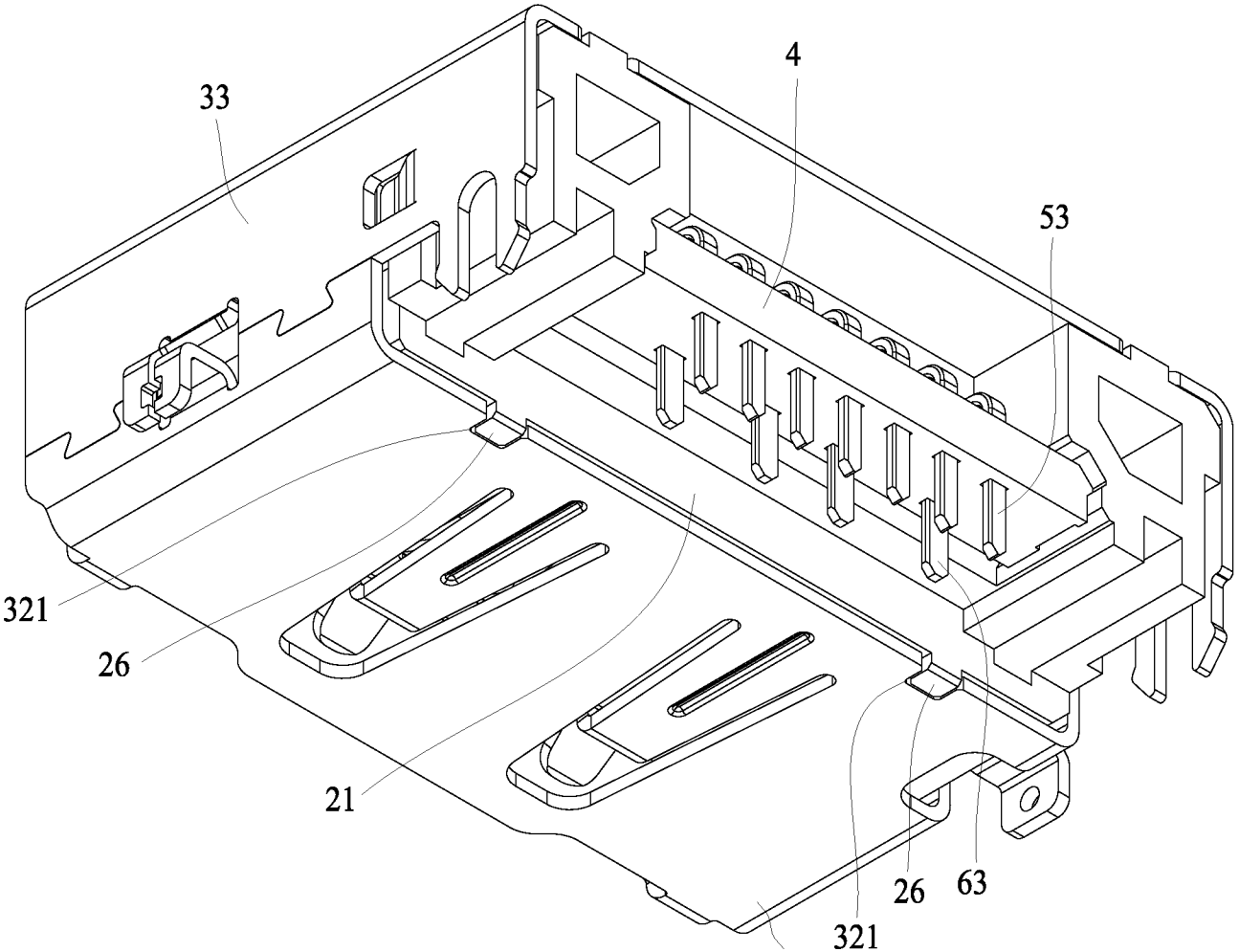
FIG. 7 is another perspective view of the electrical connector depicted in FIG. 3.
Figure 8:
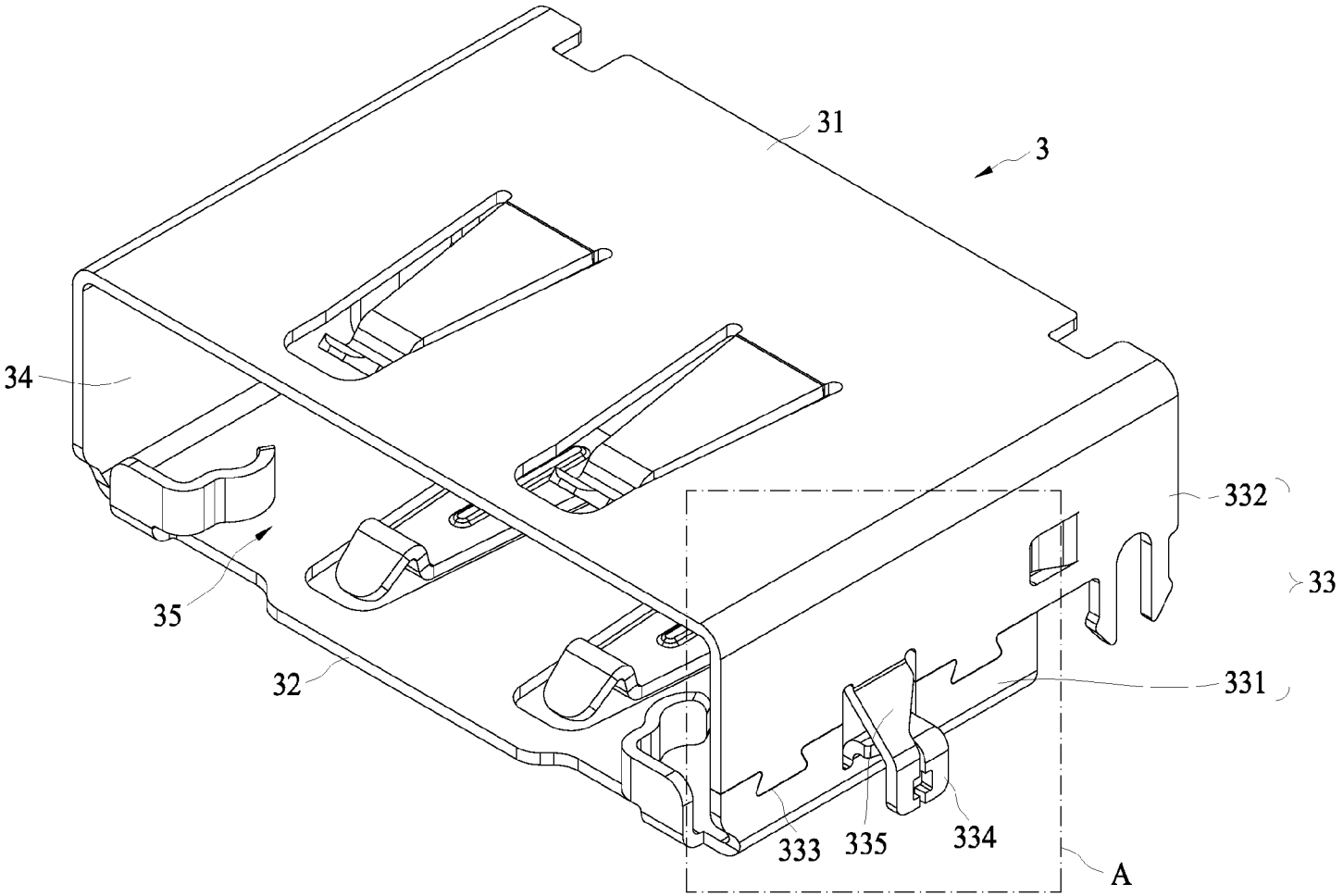
FIG. 8 is a perspective view of an embodiment of a metal shell in an assembled form.
Figure 9:
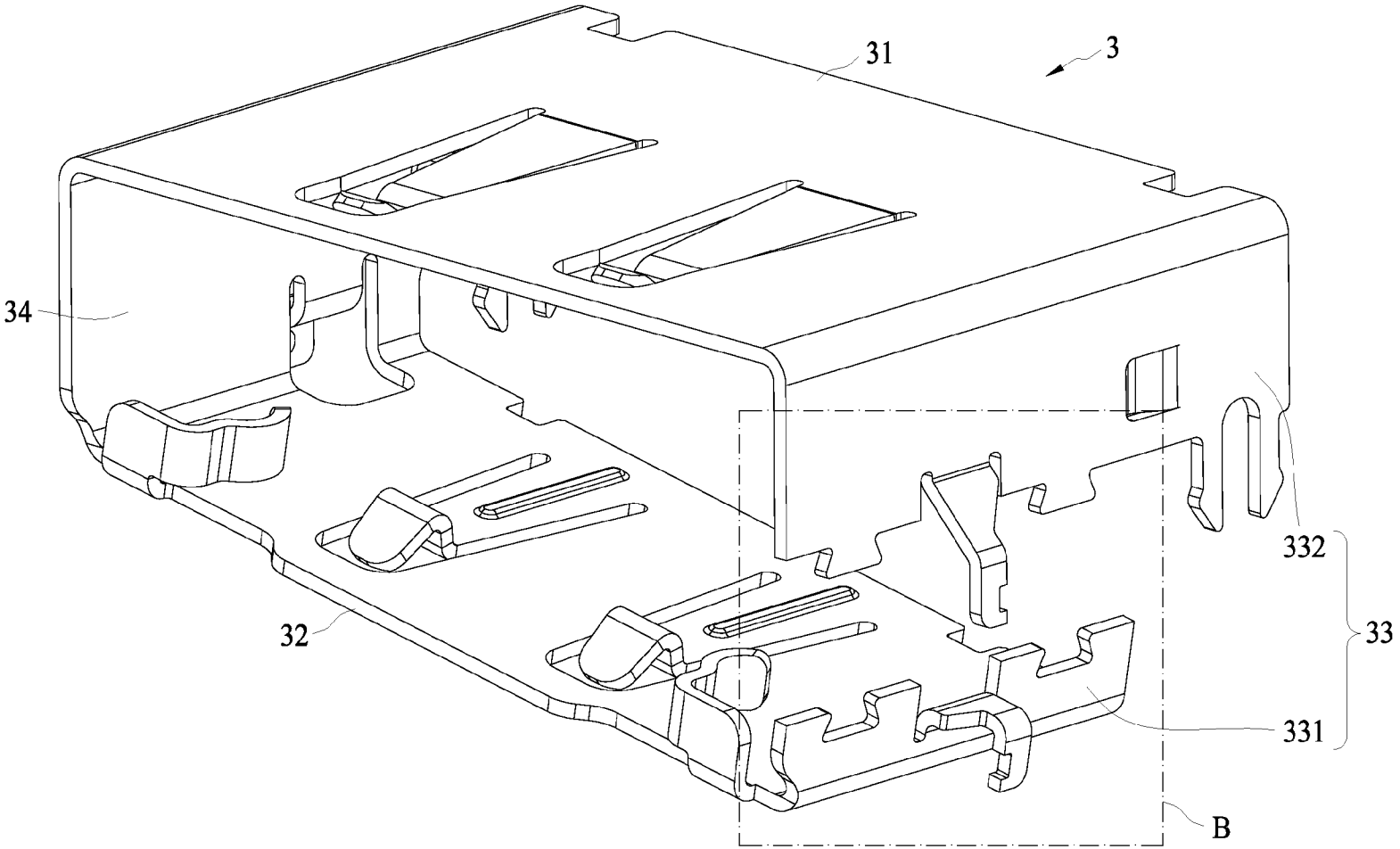
FIG. 9 is a perspective view of the metal shell depicted in FIG. 8 in partially unassembled form.
Figure 10:
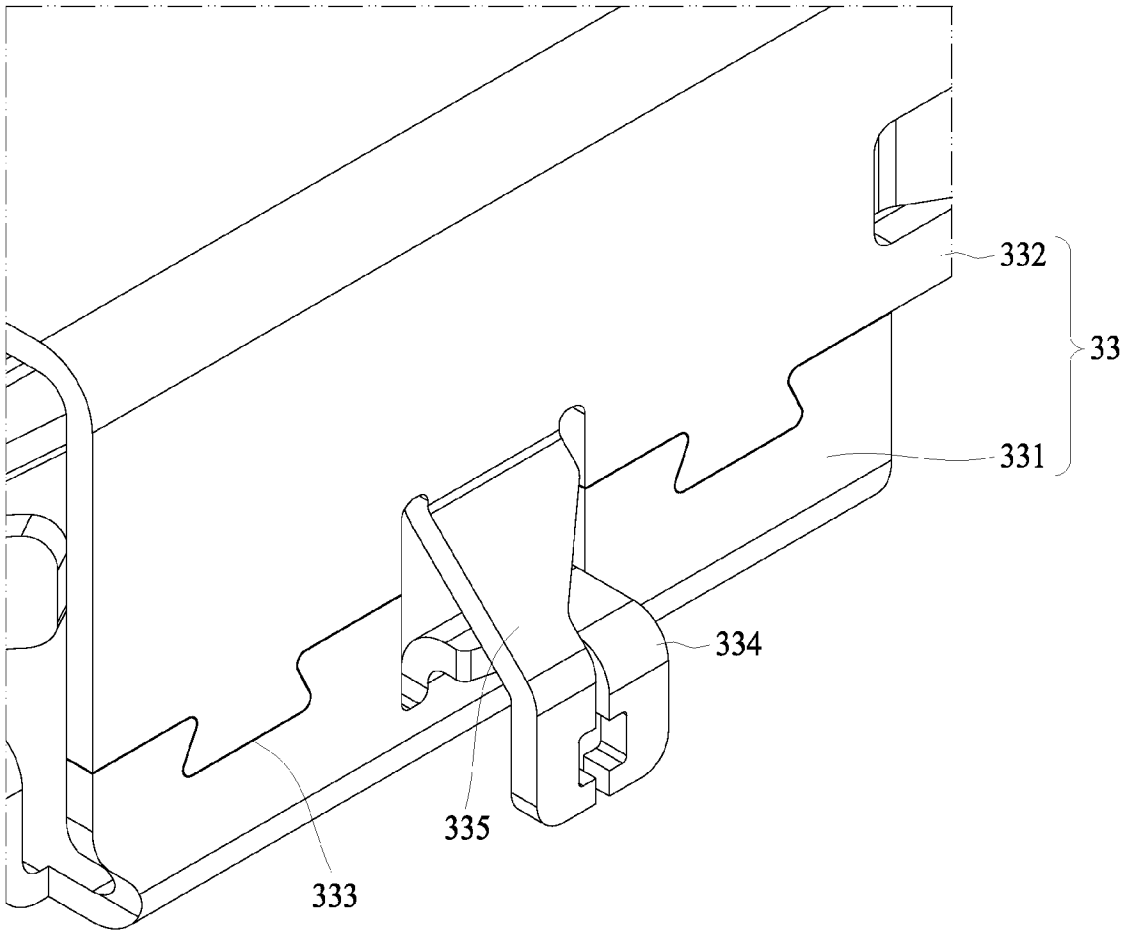
FIG. 10 is an enlarged view taken from area A of FIG. 8.
Figure 11:
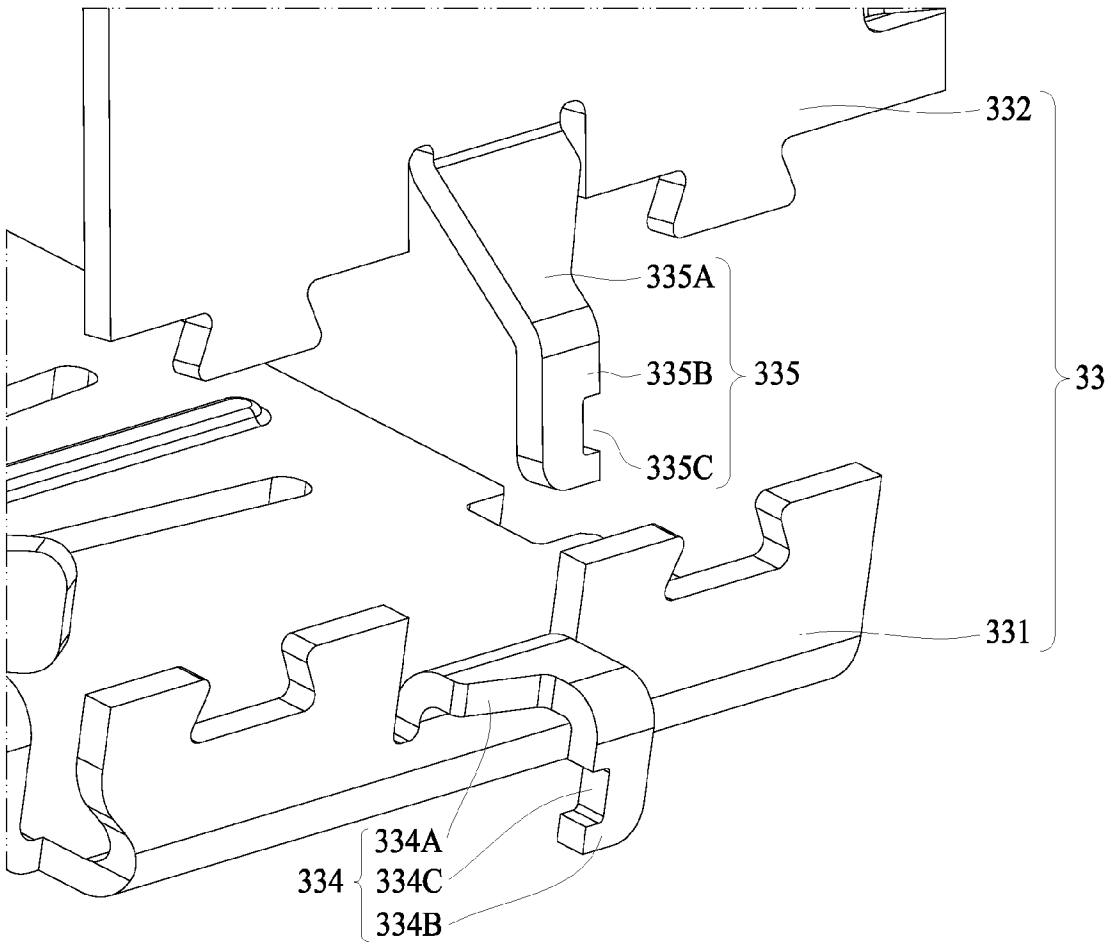
FIG. 11 is an enlarged view taken from area B of FIG. 9.
Figure 12:
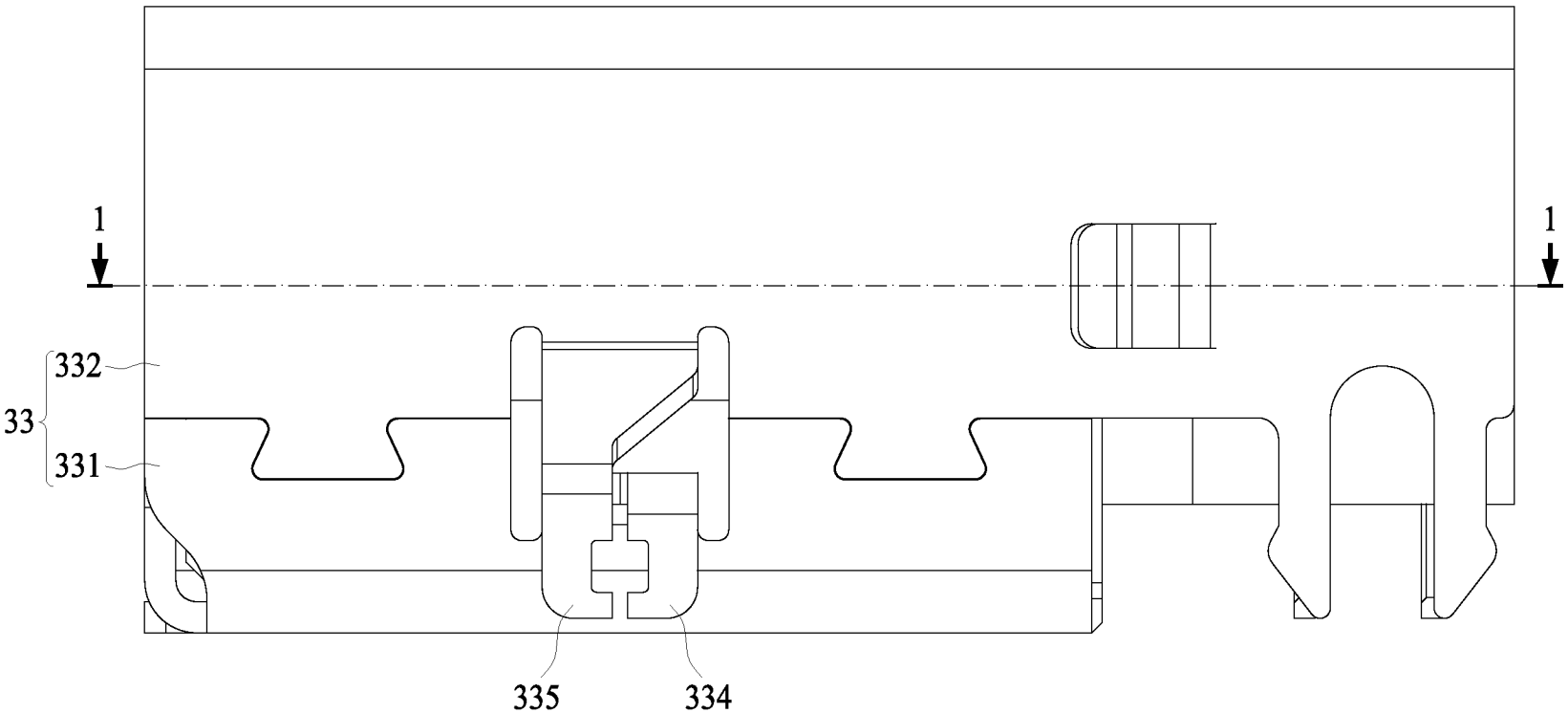
FIG. 12 is a right side view of the electrical connector of one embodiment of the present invention.
Figure 13:
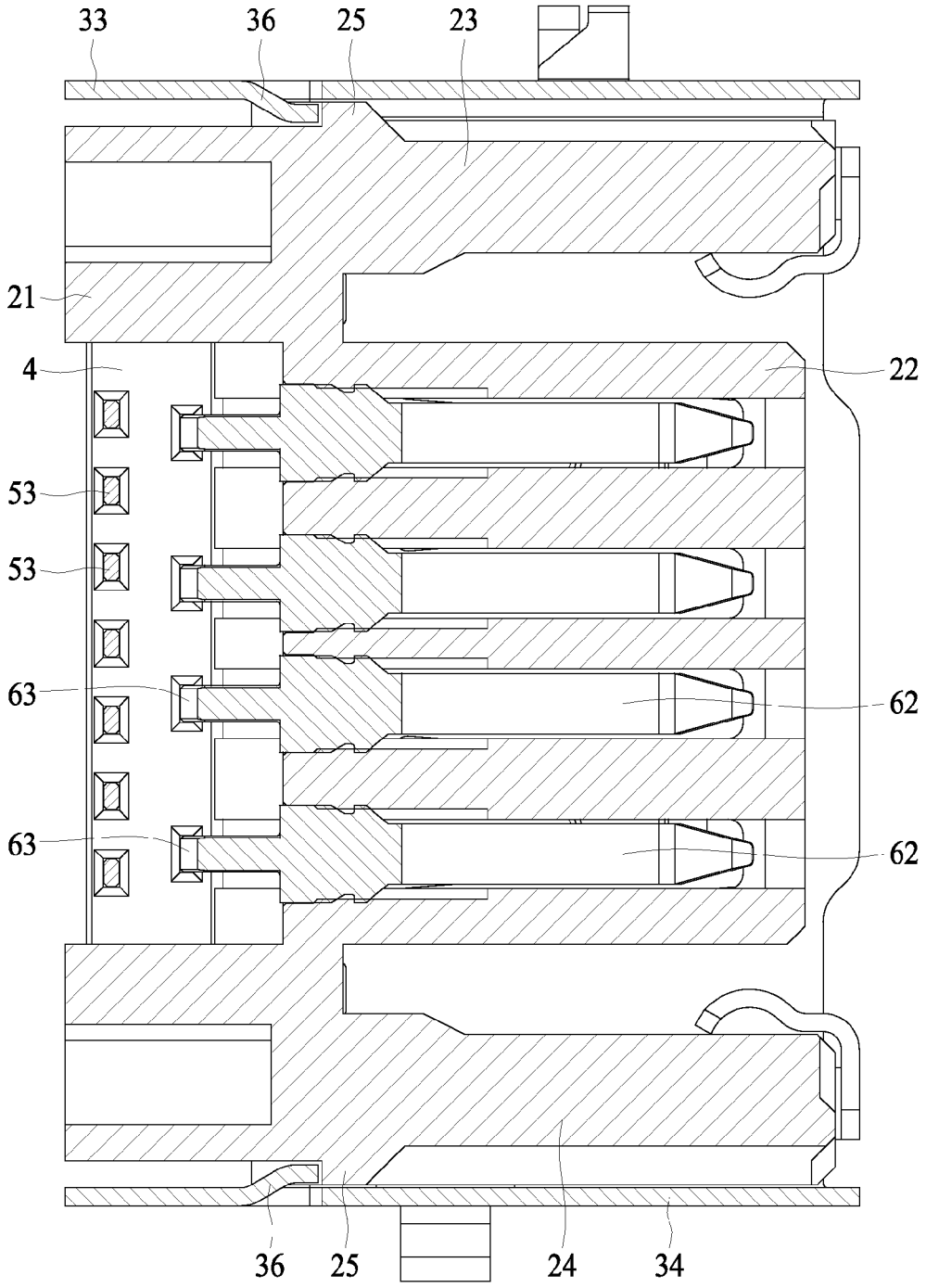
FIG. 13 is a sectional view along line 1-1 in FIG. 9.
Figure 14:
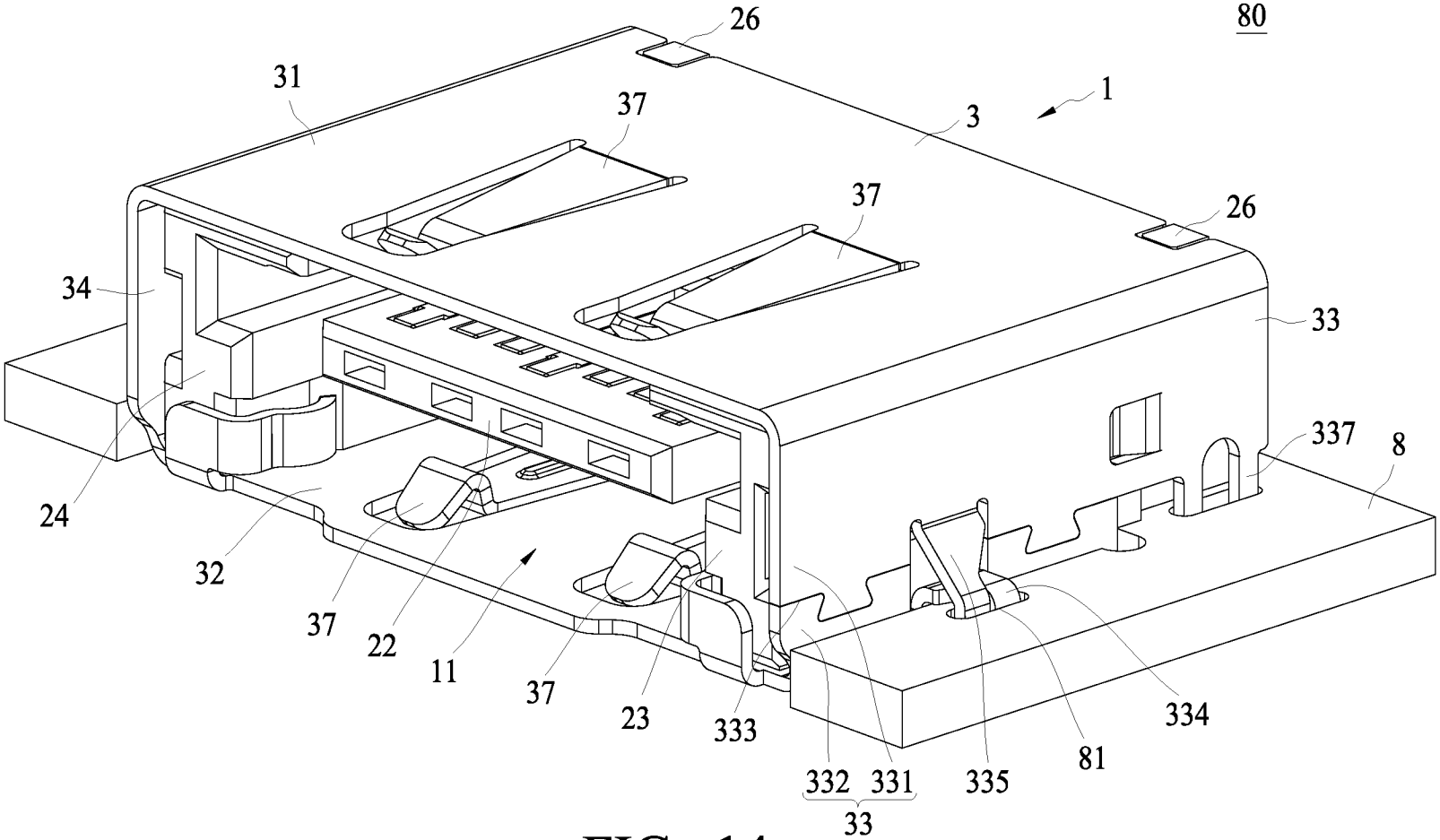
FIG. 14 is a perspective view of an electrical connector assembly mounted on a circuit board.
Figure 15:
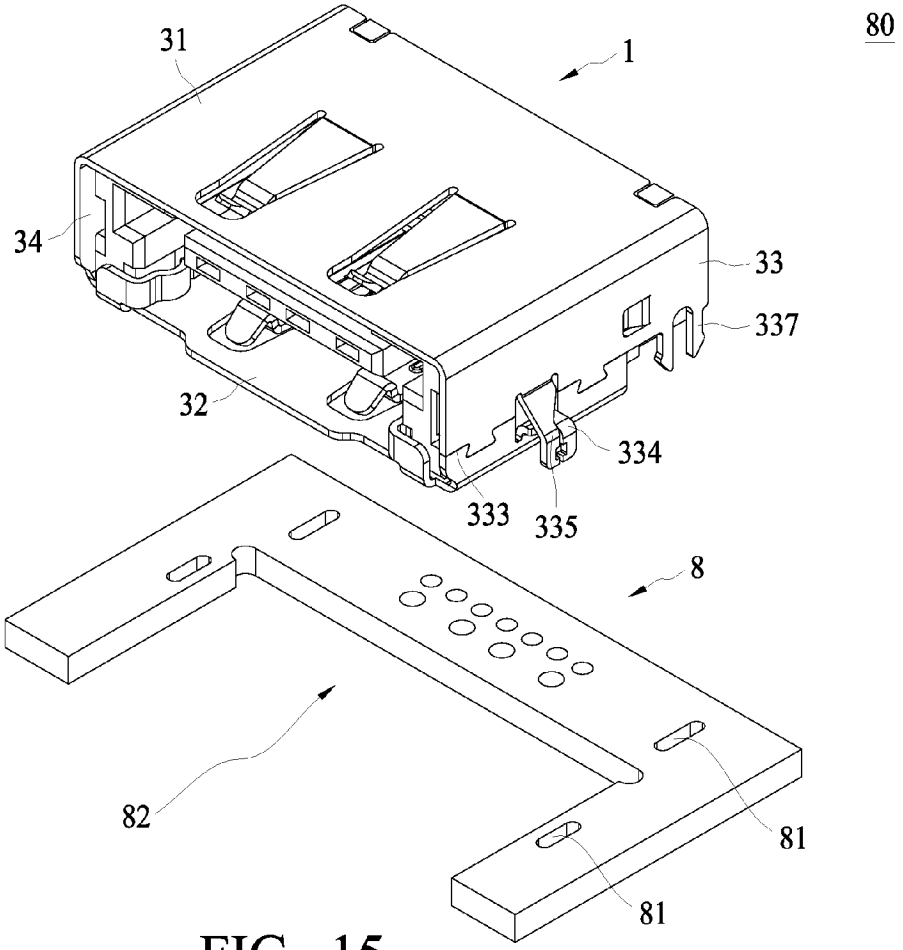
FIG. 15 is an exploded view of the embodiment depicted in FIG. 14.
Figure 16:
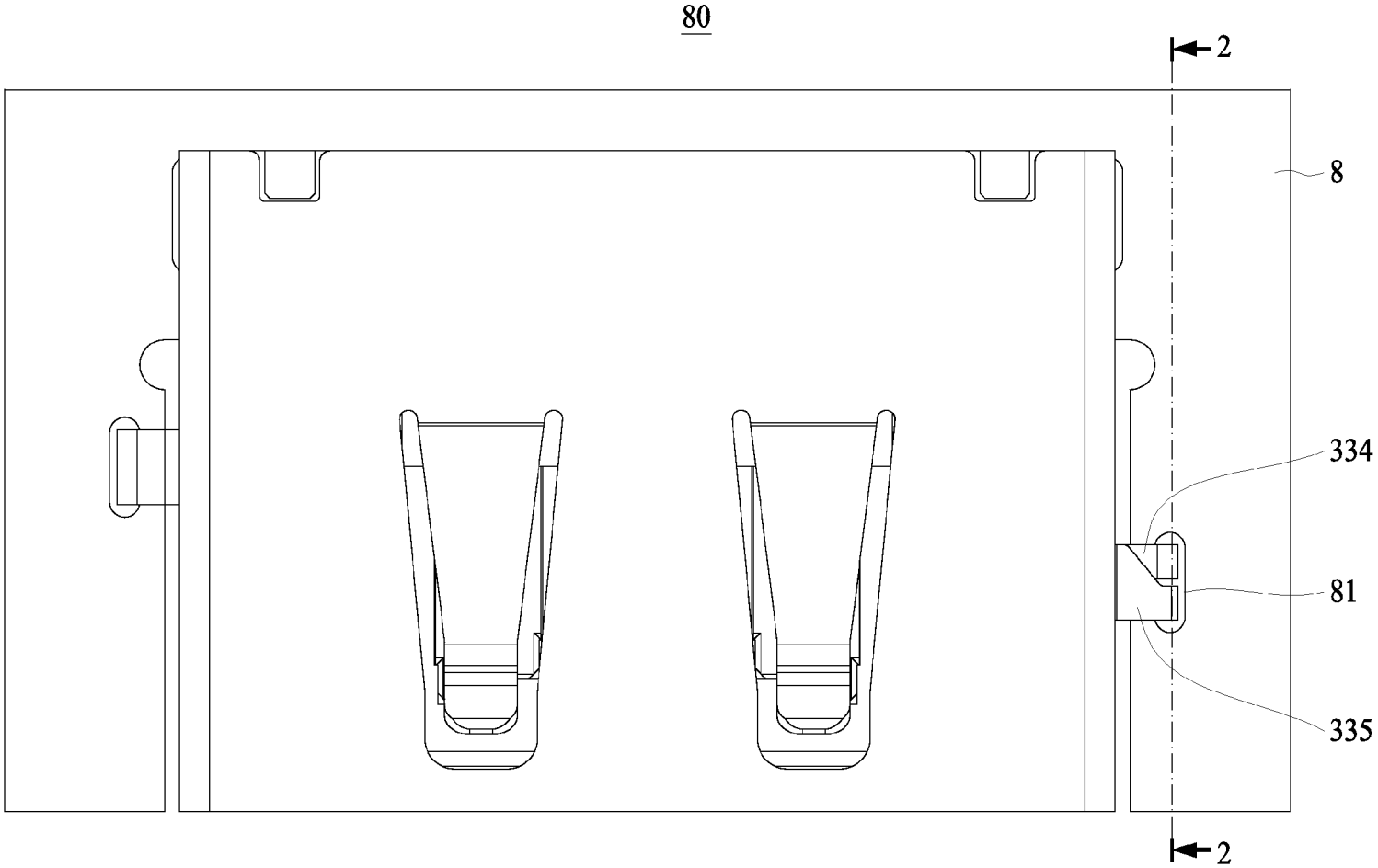
FIG. 16 is a top view of the embodiment depicted in FIG. 14.
Figure 17:
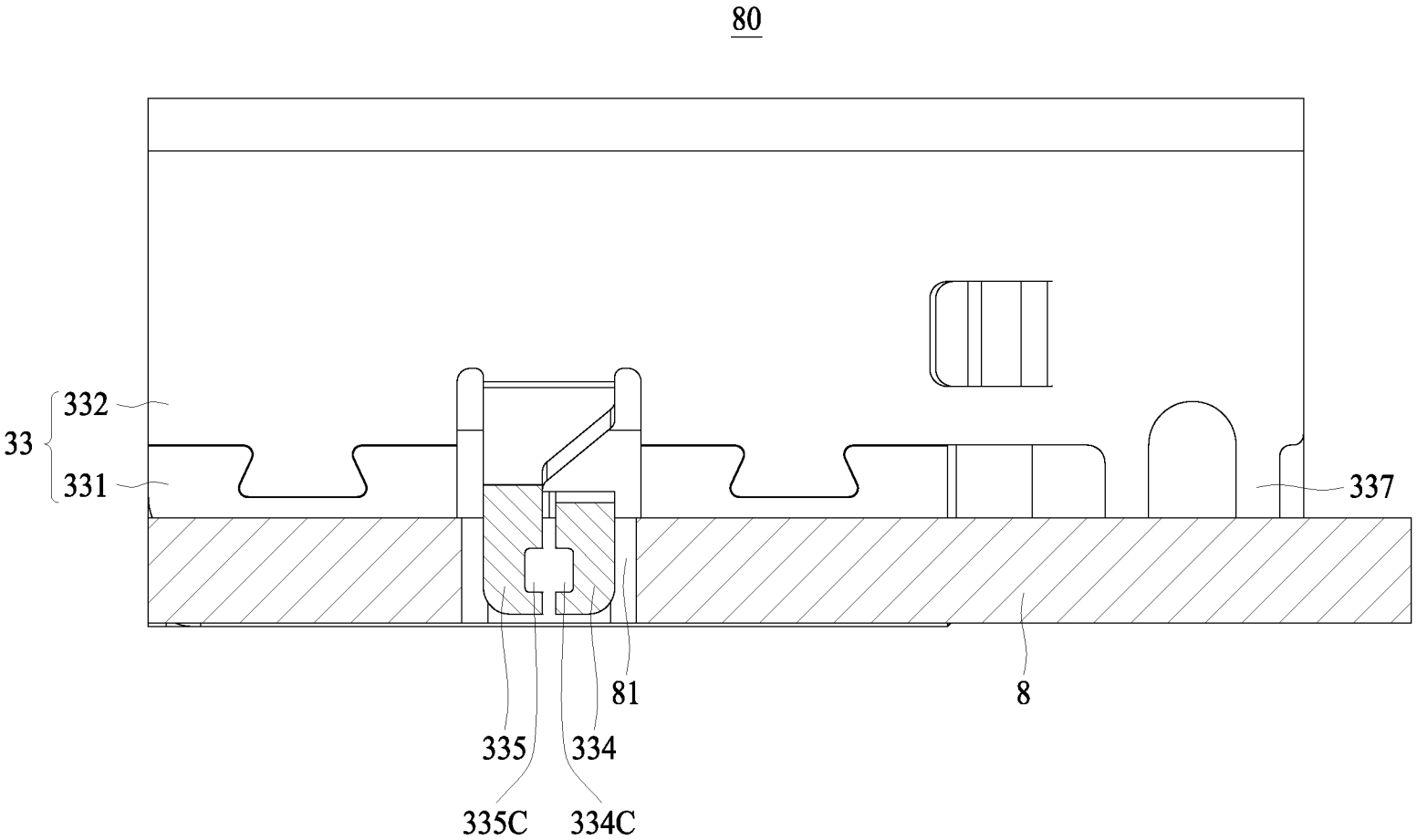
FIG. 17 is a sectional view along line 2-2 in FIG. 16.

The dielectric body 2 includes a base 21, a tongue 22 extending forward from the base 21, and two lateral arms 23 and 24 connecting the two ends of the base 21 and respectively disposed adjacent to two sides of the tongue 22. Each terminal 5 of the terminal group 50 includes a retention portion 51 for secure engagement with the dielectric body 2, a contact portion 52 extending forward from the retention portion 51, and a solder portion 53 extending backward and being bent. Each terminal 6 of the terminal group 60 includes a retention portion 61 for secure engagement with the dielectric body 2, an elastic contact portion 62 extending from the retention portion 61, and a solder portion 63 extending backward and being bent. Referring to FIG. 6, the contact portions 52 of the eSATA terminals 5 are disposed on the upper side of the tongue 22, and the contact portions 62 of the USB terminals 6 are disposed on the lower side of the tongue 22. Referring to FIG. 7, the solder portions 53 of the eSATA terminals 5 and the contact portions 62 of the USB terminals 6 extend through the terminal positioned member 4 and are assembled to the dielectric body 2 so that the solder portions 53 and 63 can be held by the terminal positioned member 4.

Referring to FIGS. 8 to 11, the metal shell 3 is integrally formed and manufactured by bending a metal plate. The metal shell 3 includes a top wall 31, a bottom wall 32 opposite to the top wall 31, and opposite first side wall 33 and second side wall 34, the four walls defining a rectangular opening 35. The first side wall 33 includes a lower wall portion 331 and an upper wall portion 332, both of which are joined at a seam 333 on the first side wall 33. The lower wall portion 331 and the upper wall portion 332 are jointed at the seam 333 by a dovetail joint having a mated tongue and a groove, located on an outside of one lateral arm 23 or 24 of the dielectric body 2. The lower wall portion 331 includes a lower solder leg 334 extending in the direction toward the bottom wall 32. The upper wall portion 332 includes an upper solder leg 335 extending in the direction toward the bottom wall 32. The lower solder leg 334 and the upper solder leg 335 are arranged adjacent to each other. The lower solder leg 334 includes a bending portion 334A and a solder portion 334B connected with the lower wall portion 331 through the bending portion 334A. The solder portion 334B has an indentation 334C. The upper solder leg 335 includes a bending portion 335A and a solder portion 335B connected with the upper wall portion 332 through the bending portion 335A. The solder portion 335B has an indention 335C. Furthermore, the solder portion 334B of the lower solder leg 334 and the solder portion 335B of the upper solder leg 335 are arranged adjacent to each other with the two indentions 334C and 335C facing each other.

The seam 333 of the metal shell 3 of the electrical connector 1 of one embodiment of the present invention is arranged on the first side wall 33 of the metal shell 3. The lower wall portion 331 and the upper wall portion 332 are butt jointed by a dovetail joint at the seam 333. Because the dovetail joint is on the first side wall 33, the damage caused by improper insertion force and twisting force from a mated connector can be avoided. In particular, a configuration in which the dovetail joint is on the first side wall 33 can effectively prevent the damage of the metal shell 3 by improper insertion force and twisting force applied on the top wall 31 and the bottom wall 32. Thus, the metal shell 3 of the electrical connector 1 of the present invention has improved rigidity. In addition, the seam 333 on the first side wall 33 of the metal shell 3 is on the outside of the lateral arm 23, which can effectively withstand improper insertion force and twisting force and avoid the effect of such forces directly on the first side wall 33 of the metal shell 3, thereby increasing the robustness of the joint at the seam 333.

Referring to FIGS. 4, 5, 12, and 13, the dielectric body 2 includes two protrusions 25 separately disposed on the lateral arms 23 and 24. The metal shell 3 further includes two latch members 36 separately disposed on the upper wall portion 332 of the first side wall 33 and the second side wall 34. During the assembly of the metal shell 3 to the dielectric body 2, the metal shell 3 is slipped on the dielectric body 2 in the direction from the front side of the dielectric body 2 to the back side of the dielectric body 2. While the metal shell 3 is being assembled to the dielectric body 2 with the latch members 36 moving over the protrusions 25, the latch members 36 are pushed outward. After the latch members 36 pass the protrusions 25 and move to designated locations, they rebound and abut against the sides of the protrusions 25 facing away from the rectangular opening 35 so that the metal shell 3 cannot be dissembled in a reverse (forward) direction. Referring to FIGS. 3 and 4 again, the dielectric body 2 includes two projections 26 disposed adjacent to the rear edge of the top surface of the base 21. The metal shell 3 includes two recesses 311 formed on the rear edge of the top wall 31 of the metal shell 3 and corresponding to the projections 26. In the same manner, as shown in FIG. 7, two additional projections 26 are formed adjacent to the rear edge of the bottom surface of the base 21 of the dielectric body 2, and the rear edge of the bottom wall 32 of the metal shell 3 is formed with two recesses 321 corresponding to the projections 26. The engagement of the protrusions 25 and 26 and the recesses 311 and 321 can prevent the metal shell 3 from moving backward after the metal shell 3 is assembled to the dielectric body 2.

FIGS. 14 to 17 show an electrical connector assembly 80 according to one embodiment of the present invention. The top wall 31 and the bottom wall 32 of the metal shell 3 are parallel to the board surface of the circuit board 8. The electrical connector 1 is assembled to the circuit board 8 in a sinking manner, which is dipped or situated in the opening 82 of the circuit board 8. The electrical connector 1 can be soldered onto the circuit board 8, electrically connecting to the circuit board 8. The circuit board 8 may include a plurality of holes 81, in which a plurality of fixing legs 337 are soldered. The solder portion 334B of the lower solder leg 334 and the solder portion 335B of the upper solder leg 335 are inserted in the same hole 81 and soldered to the circuit board 8. The lateral arms 23 and 24 of the dielectric body 2 and the metal shell 3 mutually define a plug-in slot 11 configured to allow a plug connector (not shown) to be inserted therein and having a structure to guide an inserting plug connector. The top wall 31 and the bottom wall 32 individually include two elastic arms 37 for holding an inserted plug connector. Furthermore, the bending portion 334A of the lower solder leg 334 is laid over the circuit board 8 so as to enhance its attachment.

The seam 333 of the metal shell 3 of the electrical connector assembly 80 of one embodiment of the present invention is arranged on the first side wall 33 of the metal shell 3. The lower wall portion 331 and the upper wall portion 332 are butt jointed by a dovetail joint at the seam 333. Because the dovetail joint is on the first side wall 33, the damage caused by improper insertion force and twisting force from a mated connector can be avoided. In particular, a configuration in which the dovetail joint is on the first side wall 33 can effectively prevent the damage of the metal shell 3 if improper insertion force and twisting force is applied on the top wall 31 and the bottom wall 32. Thus, the metal shell 3 of the electrical connector 1 of the present invention has improved rigidity. In addition, the seam 333 on the first side wall 33 of the metal shell 3 is on the outside of the lateral arm 23, which can withstand improper insertion force and twisting force and avoid the effect of such forces directly on the first side wall 33 of the metal shell 3, thereby increasing the robustness of the joint at the seam 333.

In addition, in the electrical connector assembly 80, the electrical connector 1 can further withstand improper force and twisting force applied to its top wall 31 and bottom wall 32 by soldering the lower solder leg 334 and the upper solder leg 335, which extend respectively from the lower wall portion 331 and the upper wall portion 332 and along a direction toward the circuit board 8, in a hole 81 of the circuit board 8. Further, the indentation 334C of the lower solder leg 334 and the indention 335C of the upper solder leg 335 allow filling of more solder so as to increase the solder strength between the lower and upper solder legs 334, 335 and the hole 81, and to be able to withstand further improper insertion force and twisting force applied to the top wall 31 and bottom wall 32. With the above features, one of the objectives of the present invention can be achieved.

The above-described embodiments of the present invention are intended to be illustrative only. Numerous alternative embodiments may be devised by persons skilled in the art without departing from the scope of the following claims.

What is claimed is:

1. An electrical connector, comprising:

a dielectric body having a base and a tongue extending forward from the base;

a plurality of terminals disposed on the tongue; and a metal shell disposed around the dielectric body, the metal shell composed of a single metal plate bent into a top wall, a bottom wall opposite to the top wall, a first side wall, and a second side wall, defining a rectangular opening; the first side wall comprises a lower wall portion and an upper wall portion that are joined together at a seam on the first side wall; the lower wall portion having a lower solder leg extending in a direction toward the bottom wall; the upper wall portion having an upper solder leg extending the direction toward the bottom wall; such that the lower solder leg and upper solder leg are adjacent one another.

2. The electrical connector of claim 1, wherein the lower solder leg includes a first solder portion and the upper solder leg includes a second solder portion formed adjacent to the solder portion of the lower solder leg.

3. The electrical connector of claim 2, wherein the lower solder leg includes a first indentation and the upper solder leg includes a second indentation opposing the first indentation.

4. The electrical connector of claim 2, wherein the lower solder leg further comprises a bending portion connecting the lower wall portion and the solder portion.

5. The electrical connector of claim 4, wherein the upper solder leg further comprises a bending portion connecting the upper wall portion and the solder portion.

6. The electrical connector of claim 5, wherein the dielectric body includes two lateral arms connecting two ends of the base and respectively disposed adjacent to two sides of the tongue, wherein the seam on the first side wall of the metal shell is on an outside of one of the two lateral arms.

7. The electrical connector of claim 6, wherein the terminals are arranged into two groups, wherein one group of the terminals are disposed on one side of the tongue, arranged to comply with the external serial advanced technology attachment (eSATA) specification, and another group of the terminals are disposed on another side of the tongue, arranged to comply with the universal serial bus (USB) specification.

8. The electrical connector of claim 1, wherein the lower and upper wall portions are connected by a dovetail joint.

9. An electrical connector assembly, comprising:

a circuit board; and an electrical connector, comprising:

a dielectric body having a base and a tongue extending forward from the base;

a plurality of terminals disposed on the tongue; and a metal shell disposed around the dielectric body, the metal shell composed of a single metal plate bent into a top wall parallel to a board surface of the circuit board, a bottom wall opposite to the top wall and parallel to the board surface of the circuit board, a first side wall, and a second side wall, defining a rectangular opening; the first side wall comprises a lower wall portion and an upper wall portion, both of which are jointed at a seam on the first side wall; the lower wall portion having a lower solder leg extending in a direction toward the circuit board; the upper wall portion having an upper solder leg extending in the direction toward the circuit board; such that the lower solder leg and upper solder leg are adjacent one another.

10. The electrical connector assembly of claim 9, wherein the lower solder leg includes a first solder portion and the upper solder leg includes a second solder portion formed adjacent to the first solder portion.

11. The electrical connector assembly of claim 10, wherein the lower solder leg includes a first indentation and the upper leg includes a second indentation opposing the first indentation.

12. The electrical connector assembly of claim 10, wherein the lower solder leg further comprises a bending portion connecting the lower wall portion and the solder portion.

13. The electrical connector assembly of claim 12, wherein the upper solder leg further comprises a bending portion connecting the upper wall portion and the solder portion.

14. The electrical connector assembly of claim 13, wherein the dielectric body includes two lateral arms connecting two ends of the base and respectively disposed adjacent to two sides of the tongue, wherein the seam on the first side wall of the metal shell is on an outside of one of the two lateral arms.

15. The electrical connector assembly of claim 14, wherein the terminals are arranged into two groups, wherein one group of the terminals are disposed on one side of the tongue, arranged to comply with the external serial advanced technology attachment (eSATA) specification, and another group of the terminals are disposed on another side of the tongue, arranged to comply with the universal serial bus (USB) specification.

16. The electrical connector assembly of claim 14, wherein the circuit board includes an opening, wherein the electrical connector is dipped in the opening.

17. The electrical connector assembly of claim 14, wherein the circuit board includes a plurality of holes, wherein the upper solder leg and the lower solder leg are in one of the holes, soldered to the circuit board.

18. The electrical connector assembly of claim 14, wherein the lower and upper wall portions are connected by a dovetail joint.

* * * * *